United States Patent [19]

Degawa

[11] 4,135,862

[45] Jan. 23, 1979

[54] SWASH PLATE TYPE COMPRESSOR

[75] Inventor: Takashi Degawa, Katsuta, Japan

[73] Assignee: Hitachi, Ltd., Japan

[21] Appl. No.: 748,395

[22] Filed: Dec. 7, 1976

[30] Foreign Application Priority Data

Dec. 15, 1975 [JP] Japan ..... 50-148361

[51] Int. Cl.[2] ..... F04B 1/12

[52] U.S. Cl. ..... 417/269

[58] Field of Search ..... 417/269, 270, 271, 273; 92/128

[56] References Cited

U.S. PATENT DOCUMENTS

| | | | |
|---|---|---|---|
| 1,877,285 | 9/1932 | Eckels | 417/269 X |
| 3,215,341 | 11/1965 | Francis | 417/269 |
| 3,904,320 | 9/1975 | Kishi et al. | 417/269 |
| 3,930,758 | 1/1976 | Park | 417/269 |
| 3,955,899 | 5/1976 | Nakayama et al. | 417/269 |

FOREIGN PATENT DOCUMENTS

| | | | |
|---|---|---|---|
| 2151128 | 5/1972 | Fed. Rep. of Germany | 417/269 |

*Primary Examiner*—John J. Vrablik
*Assistant Examiner*—Edward Look
*Attorney, Agent, or Firm*—Craig & Antonelli

[57] ABSTRACT

A swash plate type compressor composed of a pair of cylinder blocks having pistons and a swash plate mounted therein is assembled in such a manner that projections extending partially from the cylinder blocks are brought into abutting relationship. The projections are covered at their outer peripheries, through packings, with a clyindrical cover which is maintained in airtight relationship with the cylinder blocks at surfaces where they are maintained in contact with one another.

8 Claims, 2 Drawing Figures

SWASH PLATE TYPE COMPRESSOR

BACKGROUND OF THE INVENTION

This invention relates to a swash plate type compressor used with devices for cooling a cabin in a motor vehicle, and more particularly to the construction of a swash plate type compressor wherein the outer peripheral walls of cylinders serve as a shell of the compressor body. In recent years the use of a multitudinous control systems for motor vehicles has placed limitations on the space for mounting auxiliary equipment and on the weight thereof as well. The compressor of an air conditioning system for a motor vehicle is no exception.

Swash plate type compressors are superior in character to reciprocating type compressors because the former are higher in performance and produce less noise and vibration. However, the former have the inherent disadvantages of being relatively large in size and requiring a multiplicity of parts. These are the problems which should be solved in popularizing the use of swash plate type compressors.

Several proposals have been made to solve the aforesaid problems. One of such proposals known in the art consists in splitting the shell of a swash plate type compressor in two halves and bringing the two halves in abutting relationship at the center, with sealing means such as an O-ring being provided to the abutting end portions of the two halves which are clamped together from opposite sides.

Some disadvantages are associated with the swash plate type compressor constructed as aforementioned. For one thing, the abutting portions of the two halves of the shell are generally complex in shape and consequently the sealing means tends to be dislodged from its position or to go away when an external force is exerted thereon in a direction at a right angle to the axis of the compressor, with a result that gaps are formed in the sealed portion. This has made assembling of the parts a complicated process. Moreover, the aforementioned disadvantages increase the possibilities of leakage of the refrigerant from the compressor.

Moreover, the presence of the abutting sealed surface in the center makes it necessary to provide two refrigerant inlet ports, one in the left and the other in the right. Since it is difficult, due to the aforesaid limitations placed on the space, to provide a linear pipe portion of the supply piping system in the vicinity of the inlet ports, it is difficult to provide a uniform flow rate of refrigerant to the left and right chambers. This produces the following defects:

(1) The lubricant supplied with the streams of refrigerant by floating in mist form in the refrigerant is unevenly distributed to the bearings arranged symmetrically with respect to the abutting sealed surface, so that irregularities are caused to occur in the lubrication of the bearings;

(2) A variation is produced during one cycle of operation in the compression efficiency of a plurality of pistons which are generally used with this type of compressor, with the result that strain due to heat is produced in the cylinder blocks; and (3) The synergystic effect of the defects described in (1) and (2) increases vibration which is produced by the movements of the pistons.

SUMMARY OF THE INVENTION

An object of this invention is to provide a swash plate type compressor which enables sealing of its shell to be effected with increased precision.

Another object is to provide a swash plate type compressor which is easly to assemble.

Still another object is to provide a swash plate type compressor which permits vibration produced by the movement of the pistons to be reduced.

A further object is to provide a swash plate type compressor which enables lubrication of the driving portions to be effected with increased uniformity.

A still further object is to provide a swash plate type compressor which enables increased compression efficiency to be obtained.

According to the invention, there is provided a swash plate type compressor wherein a pair of cylinder blocks formed to provide a shell of the compressor body are assembled in a manner such that they are in contact with each other. The characterizing features of the invention are that end portions projecting from the pair of cylinder blocks provide projections which are maintained in contact with each other, that a cylindrical cover is provided to cover the outer peripheral portions of the projections while being maintained in contact with both cylinder blocks, and gaskets are mounted in surfaces at which the cylinder blocks and the cylindrical cover are maintained in contact with one another so as to provide an airtight seal to the contact surfaces.

DESCRIPTION OF THE PREFERRED EMBODIMENT

Figure 1:
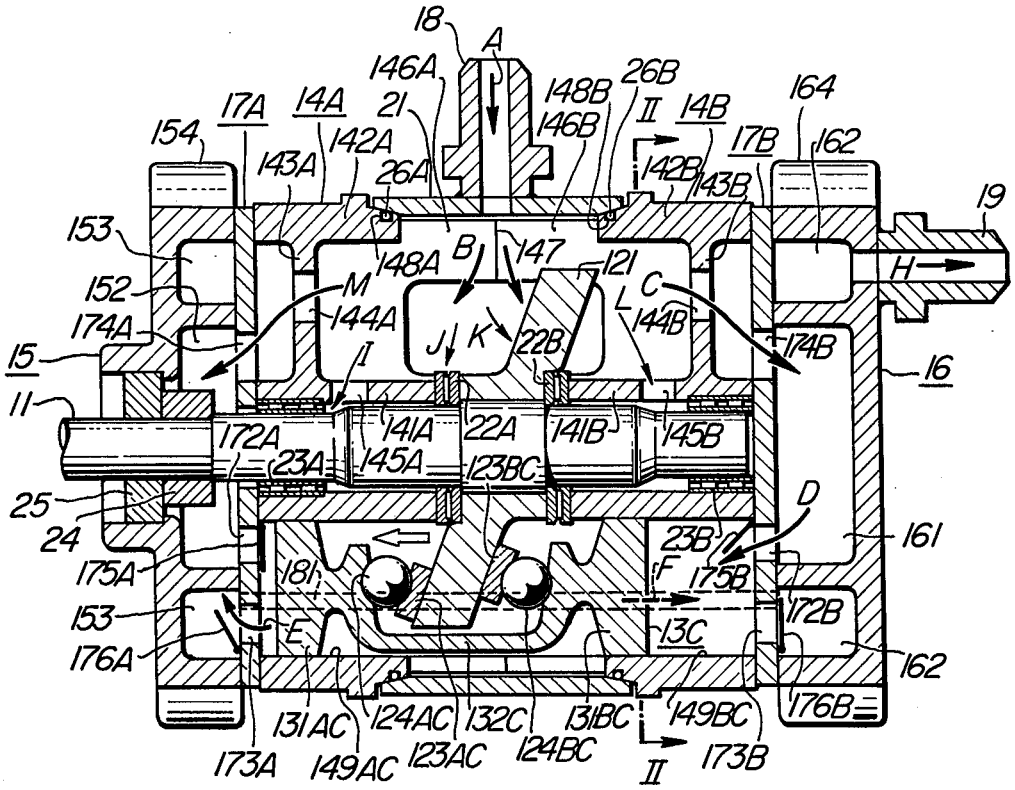
FIG. 1 is a vertical sectional view of the swash plate type compressor comprising one embodiment of this invention.

A preferred embodiment of the invention will now be described with reference to the accompanying drawings. The compressor as shown mainly comprises a drive shaft 11, a swash plate 121, piston means 13C, cylinder blocks 14A and 14B, side covers 15 and 16, valve plates 17A and 17B, a cylinder 21 and O-rings 26A and 26B.

The pair of cylinder blocks 14A and 14B are made of an aluminum alloy and constructed to have the same dimensions. The cylinder blocks 14A and 14B are formed therein with three through cylinder bores 149BC, 148BD and 149BE (See FIG. 2) which are parallel to the center axes of the cylinder blocks 14A and 14B. In portions other than the cylinder bores, the cylinder blocks 14A and 14B comprise cylindrical sleeves 141A and 141B which extend axially in the central portions of the cylinder blocks 14A and 14B respectively, walls 143A and 143B which extend radially at right angles to the cylindrical sleeves 141A and 141B respectively, cylindrical casings 142A and 142B extending axially from the outer peripheries of the walls 143A and 143B respectively, and projections 146A and 146B which extend axially from the casings 142A and 142B respectively.

The cylinder blocks 14A and 14B are arranged in juxtaposed relationship such that the projections 146A and 146B thereof are maintained in contact with each other at an abutting edge 147.

A cylinder 21 is mounted and maintained in contact with a portion of each of the casings 142A and 142B in such a manner that the cylinder 21 provides a cover to not only all the portions of the projections 146A and 146B but also a portion of each of the casings 142A and 142B disposed adjacent the projections 146A and 146B. Surfaces of the cylinder 21 which are in contact with the casings 142A and 142B are tapered, and O-ring grooves 148A and 148B are formed between these contact surfaces to receive therein the O-rings 26A and 26B respectively.

An inlet nozzle 18 for a refrigerant is secured to the outer side of the central portion of the cylinder 21 to communicate with the interior of the cylinder blocks 14A and 14B through a port formed in the cylinder 21. The sleeves 141A and 141B are formed on their inlet nozzle 18 side with lubricating oil passages 145A and 145B respectively.

The drive shaft 11 extends through the two sleeves 141A and 141B, and the swash plate 121 is affixed to the central portion of the drive shaft 11. Needle bearings 22A and 22B are mounted between the swash plate 121 and the sleeves 141A and 141B respectively, while radial bearings 23A and 23B are mounted between the drive shaft 11 and the sleeves 141A and 141B respectively.

Pistons 131AC and 131BC of the piston means which are interconnected by a U-shaped member 132C are fitted in the cylinder bores 149AC and 149BC, respectively, which are arranged coaxially in juxtaposed relationship. Pistons of the piston means 13C are fitted in like manner in other cylinder bores. The piston means 13C are mounted such that they straddle the swash plate 121. Sliding shoes 123AC and 123BC slidable along the swash plate 121 and balls 124AC and 124BC rollingly fitted between the sliding shoes 123AC and 123BC and the pistons 131AC and 131BC respectively are mounted between the U-shaped member 132C and the swash plate 121.

The circular valve plates 17A and 17B each formed with an opening in the central portion are attached to the axially outer side of the cylinder blocks 14A and 14B respectively. The cylindrical side covers 15 and 16 are attached to the outer sides of the circular valve plates 17A and 17B respectively.

The side cover 15 is formed in its central portion with an opening through which the drive shaft 11 extends. Mechanical seals 24 and 25 are mounted in the opening formed in the side cover 15 to provide an airtight seal to the side cover 15.

The side cover 15 is formed with a subtraction chamber 152 in a portion thereof which is near to the mechanical seals 24 and 25, and with an annular compression chamber 153 in a portion thereof which is near to the cylinder bores 149AC, etc. These chambers are maintained in communication with the cylinder bores 149AC, etc. through inlet ports 172A and 172B and outlet ports 173A and 173B formed in the valve plates 17A and 17B respectively. The valve plates 17A and 17B are also formed with passages 174A and 174B respectively which communicate with the subtraction chamber 152.

Check valves 175A and 175B are provided to the inlet ports 172A and 172B respectively and mounted on sides thereof which are near to the cylinder bores 149AC and 149BC, while check valves 176A and 176B are provided to the outlet ports 173A and 173B respectively and are mounted on the sides of the compression chambers 153 and 162.

The drive shaft 11 does not penetrate the side cover 16 which is formed therein with a subtraction chamber 161 and compression chamber 162 which are arranged in the same manner as the subtraction chamber 152 and compression chamber 153 in the side plate 15.

An outlet nozzle 19 is attached to the side cover 16 to communicate with the annular compression chamber 162 through an opening formed in the end wall of the side cover 16, and the compression chambers 153 and 162 are maintained in communication with each other through a line 181.

The walls 143A and 143B are formed therein with passages 144A, 174A and 144B, 174B respectively for admitting the incoming refrigerant through the inlet nozzle 18 to the substraction chambers 152 and 161.

Packings (not shown) are each sandwiched between the cylinder blocks 14A and the valve plate 17A, between the valve plate 17A and the side cover 15, between the cylinder block 14B and the valve plate 17B, and between the valve plate 17B and the side cover 16, in order to prevent leakage of the refrigerant from the compressor body.

Figure 2:
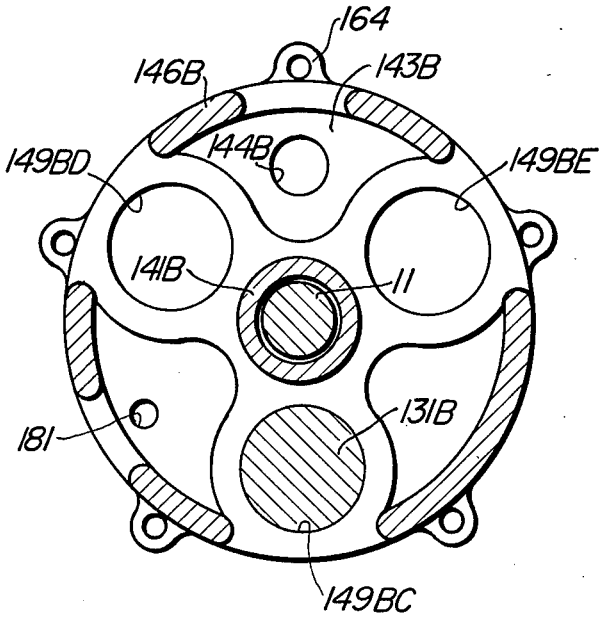
FIG. 2 is a sectional view as seen in the direction of arrows II—II of FIG. 1.

Flanges 154 and 164 are provided to the outer peripheries of the side covers 15 and 16 respectively. Openings are formed in the flanges 154, 164 as shown in FIG. 2 so as to connect together and assemble into a unitary structure the cylinder blocks 14A and 14B, valve plates 17A and 17B and side covers 15 and 16 by means of a bolt and nut arrangement (not shown).

The sleeves 141A and 141B in cylindrical form have a sufficiently large inner diameter to enable the drive shaft 11 to be received therein without any trouble when the piston means 13C are supported by the swash plate 121 secured to the drive shaft 11 and inserted in the cylinder bore 149AC, etc., thereby facilitating assembling of the parts.

Assembling of the compressor constructed as aforementioned in accordance with the invention will now be described. Assembling of the piston means 13C will be explained only with reference to the set of pistons shown in FIG. 1. It is to be understood, however, that other two sets of pistons fitted in the cylinder bores 149BD and 149BE shown in FIG. 2 are also assembled simultaneously in the same manner as the set shown in FIG. 1.

(1) The O-rings 26A and 26B are mounted in the O-ring grooves 148A and 148B formed in the cylinder blocks 14A and 14B respectively, and the contact surface of the cylinder 21 is fitted in the contact surface of the cylinder block 14B.

(2) The swash plate 121 and needle bearings 22A, 22B are secured to the drive shaft 11, and the sliding shoes 123AC and 123BC, balls 124AC and 124BC and piston means 13C are mounted in position over the swash plate 121.

(3) The piston 131BC which forms a part of the piston means 13C is fitted in the cylinder bore 149BC formed in the cylinder block 14B. This results in one end of the drive shaft 11 being inserted in the sleeve 141B, with the needle bearing 22B being brought into engagement with the sleeve 141B and supported thereby.

(4) The drive shaft is inserted into the sleeve 141A of the cylinder block 14A from the other end of the drive shaft, and at the same time the piston 131AC is fitted in the cylinder bore 149AC. Thus, the needle bearing 22A is brought into engagement with the sleeve 141A and supported thereby and the contact surface of the casing 142A is brought into contact with the contact surface of the cylinder 21.

(5) The radial bearings 23A and 23B are mounted between the drive shaft 11 and the sleeves 141A and 141B respectively.

(6) The valve plates 17A and 17B are attached, from the outside in the longitudinal direction of the drive shaft 11, to the cylinder blocks 14A and 14B respectively, with the packings being sandwitched therebetween. Then, the side covers 15 and 16 are attached to the valve plates 17A and 17B respectively.

(7) The mechanical seals 24 and 25 are mounted between the side cover 15 and the drive shaft 11.

(8) The unitary structure formed by assembling the various parts is clamped from opposite sides thereof by means of a nut and bolt arrangement (not shown) through the openings formed in the flanges 154 and 164.

Operation of the compressor in accordance with the invention will now be described.

A refrigerant A, such as Freon gas, admitted to the compressor through the inlet nozzle 18 includes a lubricating oil entrained therein during the process of performing a refrigerating cycle. Upon being introduced into the interior of the cylinder blocks 14A and 14B, the linear velocity of the refrigerant A is abruptly reduced at B, so that the mist of the lubricant entrained in the refrigerant A is divided into a stream K directed to the surfaces of the swash plate 121, a stream J directed to the needle bearings 22A and 22B, and streams I and L which pass through the passages 145A and 145B and are directed to the radial bearings 23A and 23B respectively. The streams of the lubricating oil reach the respective parts to lubricate the same. The mechanical seals 24 and 25 have their sliding surfaces lubricated by the stream M of the lubricant which passes through the passages 144A and 174A.

In FIG. 1, the piston means 13C are shown as moving in a direction indicated by a bold line arrow. In this case, the refrigerant is drawn by suction through the passages 144B and 174B and the inlet ports 172A and 172B into the cylinder bore 149BC. This suction operation is performed as follows:

When the drive shaft 11 rotates, the swash plate 121 causes the pistons 131AC and 131BC to move in reciprocating motion at regular intervals through the sliding shoes 123AC and 123BC and balls 124AC and 124BC.

If the piston 131AC moves leftwardly as shown in FIG. 1, then the pressure of the Freon gas in the cylinder bore 149BC is gradually lowered. Upon the pressure of the gas being reduced below a predetermined level, the check valve 175B disposed at the inlet port 172B opens and the check valve 176B disposed at the outlet port 173B closes. This causes a stream C of refrigerant to be drawn by suction into the cylinder bore 149BC in a stream D. Also, the leftward movement of the piston 131AC causes a gradual rise in the pressure of the gas in the cylinder bore 149AC. Upon the pressure of the gas exceeding a predetermined level, the check valve 175A disposed at the inlet port 172A closes and the check valve 176A disposed at the outlet port 173A opens. Thus a stream E of pressurized gas enters the compression chamber 153 and is led, through the line 181 in a stream F, to the compression chamber 162. From the compression chamber 162, the pressurized gas is supplied in a stream H to the cooling load. A similar operation is performed when the piston means 13C move rightwardly in FIG. 1, provided that the direction of flow of the refrigerant and hence the opening and closing of the check valves 175A, 175B and 176A, 176B are reversed from those which occur as described hereinabove.

The lubricating oil mist is supplied to the sliding surfaces at regular intervals as the piston means 13C move in reciprocatory motion.

The inlet nozzle 18 and the swash plate 121 are located in the central portion of the lengthwise extent of the swash plate type compressor, and the compressor is constructed such that the refrigerant flows uniformly to the left and right sides of the compressor after being admitted to its interior.

This construction of the compressor can be readily obtained as presently to be explained. In its assembled state shown in FIG. 1, the compressor comprises the cylinder blocks 14A and 14B which are in contact with each other only at abutting edge 147 where the projections of the two cylinder blocks contact each other and at the sleeves 141A and 141B through the needle bearings 22A, 22B and the swash plate 21. More specifically, a gap is formed between the cylinder 21 and the cylinder blocks 14A and 14B in the axial direction, and the O-rings are provided to the tapered contact surfaces of the cylinder 21 and the cylinder blocks 14A and 14B. Thus, by virtue of the resilience of the O-rings, the axial dimension of the assembled compressor is adjustable in this portion of the shell and has nothing to do with the centering of the swash plate.

The production steps of the compressor constructed as aforesaid will be described. First of all, the surfaces of the cylinder blocks 14A and 14B which are brought into engagement with the valve plates 17A and 17B respectively are machined in such a manner that they are perpendicular to the sleeves 141A and 141B respectively. Then the sleeves 141A and 141B are machined such that they are equal to each other with a high degree of precision in their axial lengths. Finally, the edges the cylinder blocks 14A and 14B which are adapted to come into contact with each other at 147 are slightly cut to remove the material of the cylinder blocks so that the height of the cylinder blocks 14A and 14B up to the edges thereof adapted to contact at abutting edge 147 in the axial direction will be one half the total of the axial lengths of the sleeves 141A, 141B, needle bearings 22A, 22B and the base of the swash plate 121.

What is claimed is:

1. A swash plate compressor comprising:

a pair of cylinder blocks each of which has a cylindrical casing portion, a plurality of projections spaced from each other and axially extending from one end of said cylindrical casing portion, and at least a cylinder bore formed therein, said pair of cylinder blocks being axially arranged so that said projections of one of said cylinder blocks contact with the projections of the other cylinder block and said cylinder bores are in alignment with each other;

a drive shaft mounted rotatably on and coaxially of said pair of cylinder blocks;

a swash plate secured to said drive shaft;

pistons fitted in each of said cylinder bores, said pistons being operatively engaged with said swash plate so that said pistons are reciprocated by said swash plate rotating with said drive shaft;

a cylinder disposed to surround all said projections of said cylinder blocks and said end portions of said cylindrical casing portions from which said projections are extended axially, both ends of said cylinder terminating at said end portions of said cylindrical casing portions whereby a major extent of peripheral surfaces of said cylinder blocks are exposed;

gaskets disposed on said end portions of said cylindrical casing portions for sealing airtightly between said end portions of said cylindrical casing portions and said cylinder; and enclosure means disposed at both ends of said cylinder blocks for enclosing the said ends, said enclosure means including passages for refrigerant communicating with said cylinder bores.

2. A swash plate compressor according to claim 1, in which said cylinder has a refrigerant inlet nozzle.

3. A swash plate compressor according to claim 2, in which both said cylinder and the end portions formed of said cylindrical casing portions of said cylinder blocks have tapered surfaces through which they contact each other.

4. A swash plate compressor according to claim 1, in which both said cylinder and said end portions of said cylindrical casing portions of said cylinder blocks, from which end portions of said projections are extended, have tapered surfaces through which they contact each other.

5. A swash plate compressor comprising:

a pair of cylinder blocks each of which has a cylindrical casing portion having an annular and tapered face at the periphery of one end thereof and an annular groove formed on said annular and tapered face, a plurality of projections spaced from each other and axially extending from said end of said cylindrical casing portion, and a plurality of cylinder bores formed therein, said pair of cylinder blocks being axially arranged so that said projections of one of said cylinder blocks contacts with the projections of the other cylinder block and said cylinder bores of one of said cylinder blocks are in alignment with the cylinder bores of the other cylinder block;

a drive shaft mounted rotatably on and coaxially of said pair of cylinder blocks;

a swash plate secured to said drive shaft;

pistons fitted in each of said cylinder bores, said pistons being operatively engaged with said swash plate so that said pistons are reciprocated by the swash plate upon rotation of said swash plate;

a cylindrical cover enclosing all said projections of said cylinder blocks and said tapered end portions of said cylindrical casing portions, both ends of said cylinder terminating at said tapered end portions of said cylindrical casing portions and having tapered faces facing said annular and tapered faces of said cylindrical casing portions;

gaskets disposed in said annular grooves for sealing the gaps between both said tapered surfaces of said cylindrical cover and said cylinder blocks; and enclosure means disposed at both ends of said cylinder blocks assembled for enclosing said ends, said enclosure means including passages for refrigerant communicating with said cylinder bores.

6. A swash plate compressor according to claim 5, wherein said gaskets comprise O-rings.

7. In a swash plate compressor of the type having a pair of cylinder blocks each of which has a cylindrical casing portion and a plurality of projections extending axially from an end portion thereof into abutting contact with the projections on the other of said cylinder blocks, a swash plate rotatively mounted for driving pistons mounted within a casing formed by said pair of cylindrical blocks, and a cylinder disposed to surround all of said projections of said cylinder blocks, the improvement comprising:

said cylinder being provided with surfaces at the ends thereof, a surface on the end portion of each of said cylinder blocks abuttingly engaging a respective one of said surfaces of said cylinder, and seal means disposed between the abuttingly engaging surfaces for providing an airtight seal, wherein said surfaces of said end portions of the cylindrical blocks and the surfaces of said cylinder are tapered and wherein seal means are disposed between said tapered surfaces.

8. A swash plate compressor according to claim 7, wherein said seal means is formed by O-ring gaskets disposed with grooves within one of each of said respective abuttingly engaging surfaces.

* * * * *